US012215481B2

(12) United States Patent
Kim et al.

(10) Patent No.: US 12,215,481 B2
(45) Date of Patent: Feb. 4, 2025

(54) CONSTRUCTION EQUIPMENT

(71) Applicant: VOLVO CONSTRUCTION EQUIPMENT AB, Eskilstuna (SE)

(72) Inventors: Dongsoo Kim, Gyeongsangnam-do (KR); Miok Kim, Gyeongsangnam-do (KR)

(73) Assignee: VOLVO CONSTRUCTION EQUIPMENT AB, Eskilstuna (SE)

( * ) Notice: Subject to any disclaimer, the term of this patent is extended or adjusted under 35 U.S.C. 154(b) by 723 days.

(21) Appl. No.: 17/601,141

(22) PCT Filed: Apr. 5, 2019

(86) PCT No.: PCT/KR2019/004108
§ 371 (c)(1),
(2) Date: Oct. 4, 2021

(87) PCT Pub. No.: WO2020/204238
PCT Pub. Date: Oct. 8, 2020

(65) Prior Publication Data

US 2022/0170238 A1 Jun. 2, 2022

(51) Int. Cl.
*E02F 9/20* (2006.01)
*E02F 9/22* (2006.01)
(Continued)

(52) U.S. Cl.
CPC ..... *E02F 9/2033* (2013.01); *E02F 9/2214* (2013.01); *E02F 9/262* (2013.01)

(58) Field of Classification Search
CPC ..... E02F 3/43; E02F 9/20; E02F 9/22; E02F 5/02; G05D 3/20; F15B 21/08
See application file for complete search history.

(56) References Cited

U.S. PATENT DOCUMENTS 5,704,429 A * 1/1998 Lee ..... E02F 9/2004 701/50
5,903,988 A * 5/1999 Tochizawa ..... E02F 3/437 701/50
(Continued)

FOREIGN PATENT DOCUMENTS

EP 2072691 A1 6/2009
JP 07-180173 A 7/1995
(Continued)

OTHER PUBLICATIONS

Office Action for Korean Patent Application No. 10-2021-7033390, mailed Jul. 18, 2023, 6 pages.
(Continued)

*Primary Examiner* — Tan Q Nguyen
(74) *Attorney, Agent, or Firm* — Sage Patent Group

(57) ABSTRACT

Provided is construction equipment including: an undercarriage; an upper swing body rotatably supported on the undercarriage; a work device supported by the upper swing body and comprising a boom, an arm and a bucket, which operate by means of respective hydraulic cylinders; a control valve for controlling the boom cylinder; an electronic proportional pressure reducing valve for controlling a spool of the control valve; a control lever for outputting a control signal corresponding to the amount of control of a driver; a work setting unit for providing a work mode and target work surface setting function; a location information providing unit for, according to a work mode setting of the work setting unit, collecting and/or calculating location information of the work device and location information of a work surface that has been set; and an electronic control unit.

7 Claims, 5 Drawing Sheets

(51) Int. Cl.
*E02F 9/26* (2006.01)
*G05D 3/20* (2006.01)

(56) References Cited

U.S. PATENT DOCUMENTS

| | | | | |
|---|---|---|---|---|
| 8,972,121 | B2 * | 3/2015 | Kurikuma | E02F 3/325 701/50 |
| 2015/0240445 | A1 * | 8/2015 | Guo | E02F 3/435 701/50 |
| 2015/0308082 | A1 * | 10/2015 | Takaura | E02F 3/32 701/50 |
| 2016/0251836 | A1 * | 9/2016 | Baba | E02F 9/265 701/50 |

FOREIGN PATENT DOCUMENTS

| | | | |
|---|---|---|---|
| JP | 08-302754 | A | 11/1996 |
| JP | 11-190042 | A | 7/1999 |
| JP | 2008106440 | A | 5/2008 |
| KR | 10-0335361 | B1 | 8/2002 |
| KR | 10-2002-0085663 | A | 11/2002 |
| KR | 20150133118 | A | 11/2015 |

OTHER PUBLICATIONS

International Search Report and Written Opinion of the International Searching Authority, PCT/KR2019/004108, mailed Jan. 3, 2020, 10 pages.
Chinese Office Action, for Chinese Application No. 201980095169.0, mailed Oct. 25, 2022, 7 pages.
European Search Report, for European Patent No. 19923217.4, mailed Nov. 10, 2022, 8 pages.

* cited by examiner

[Fig. 1]
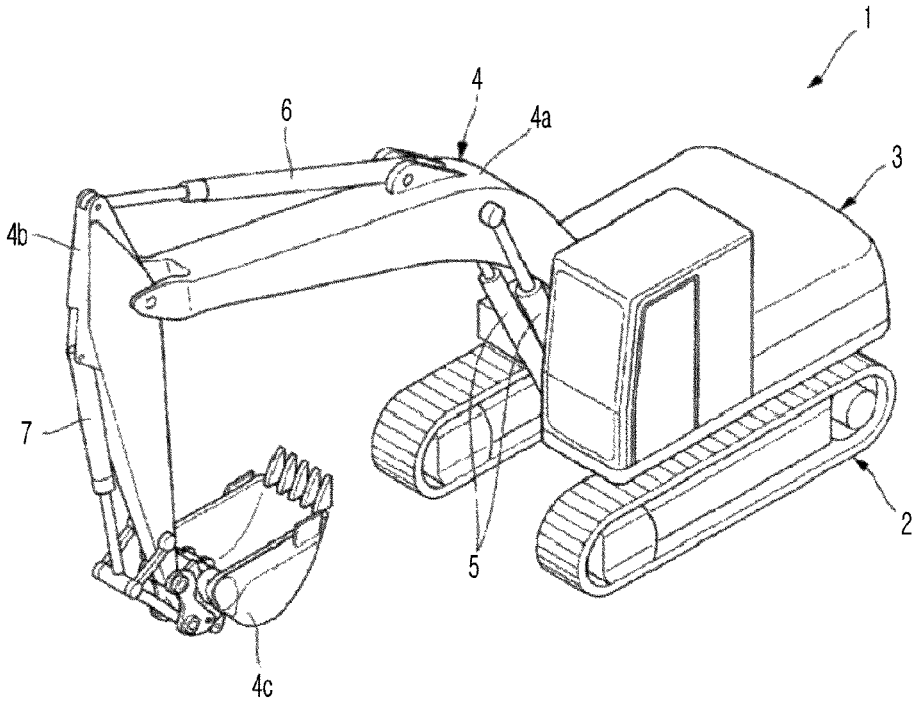
Prior Art

[Fig. 2]
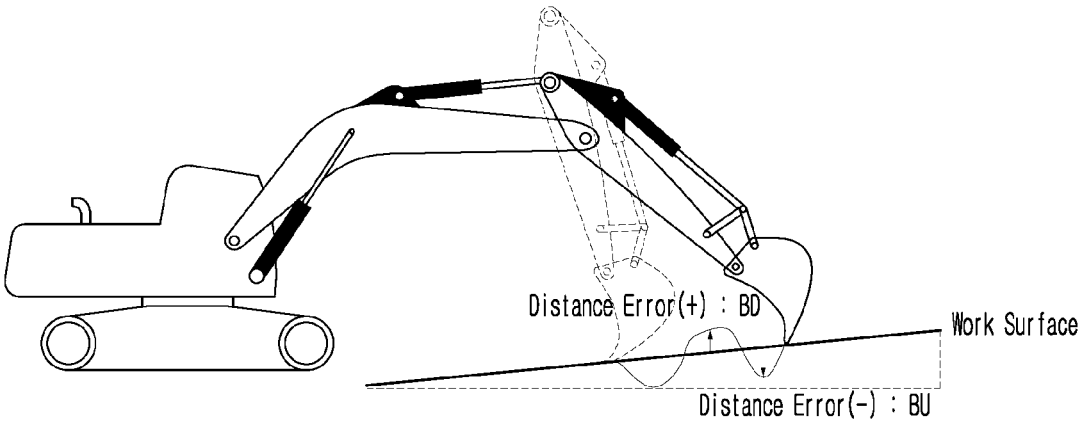
Prior Art

[Fig. 3]
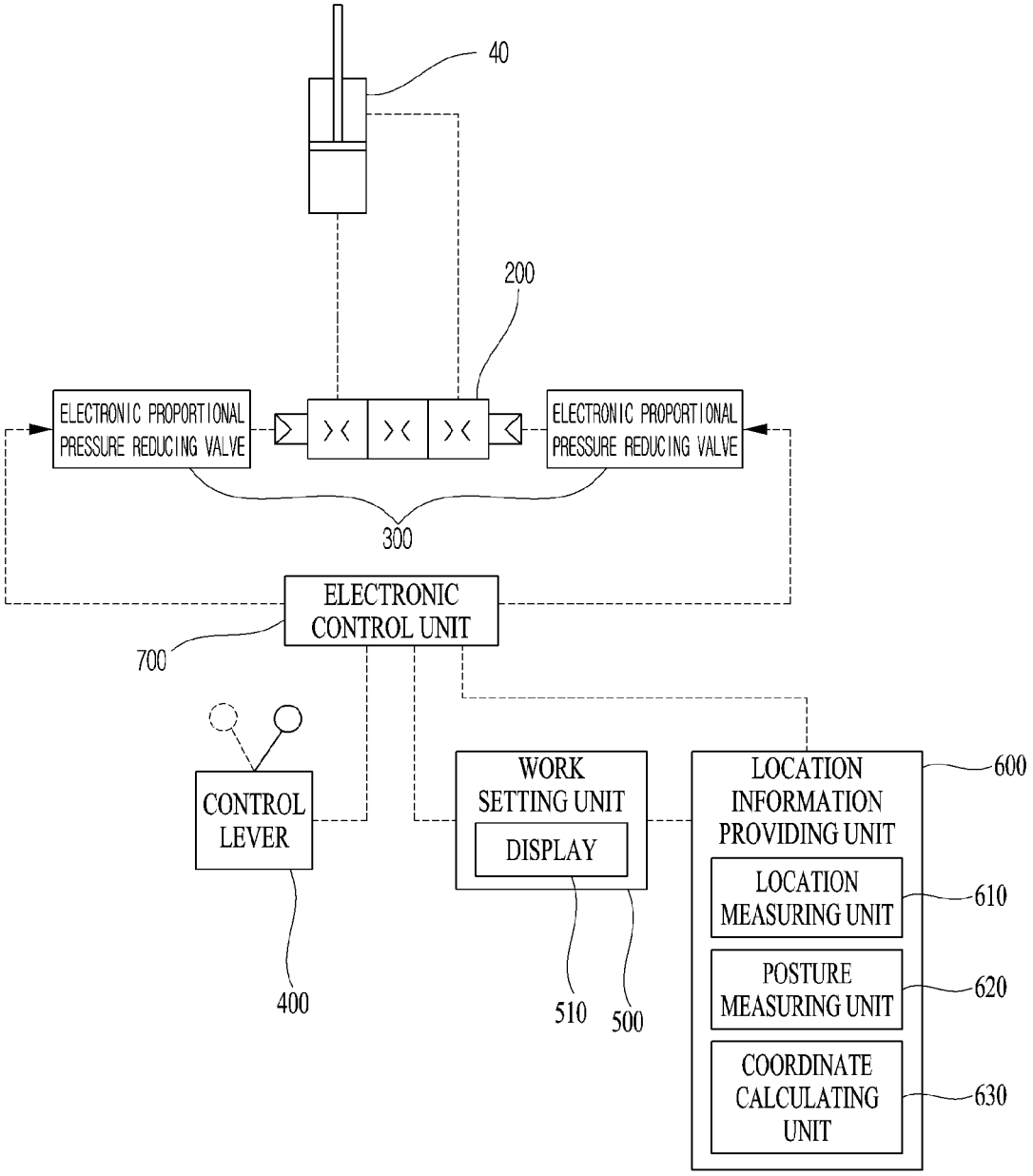

[Fig. 4]
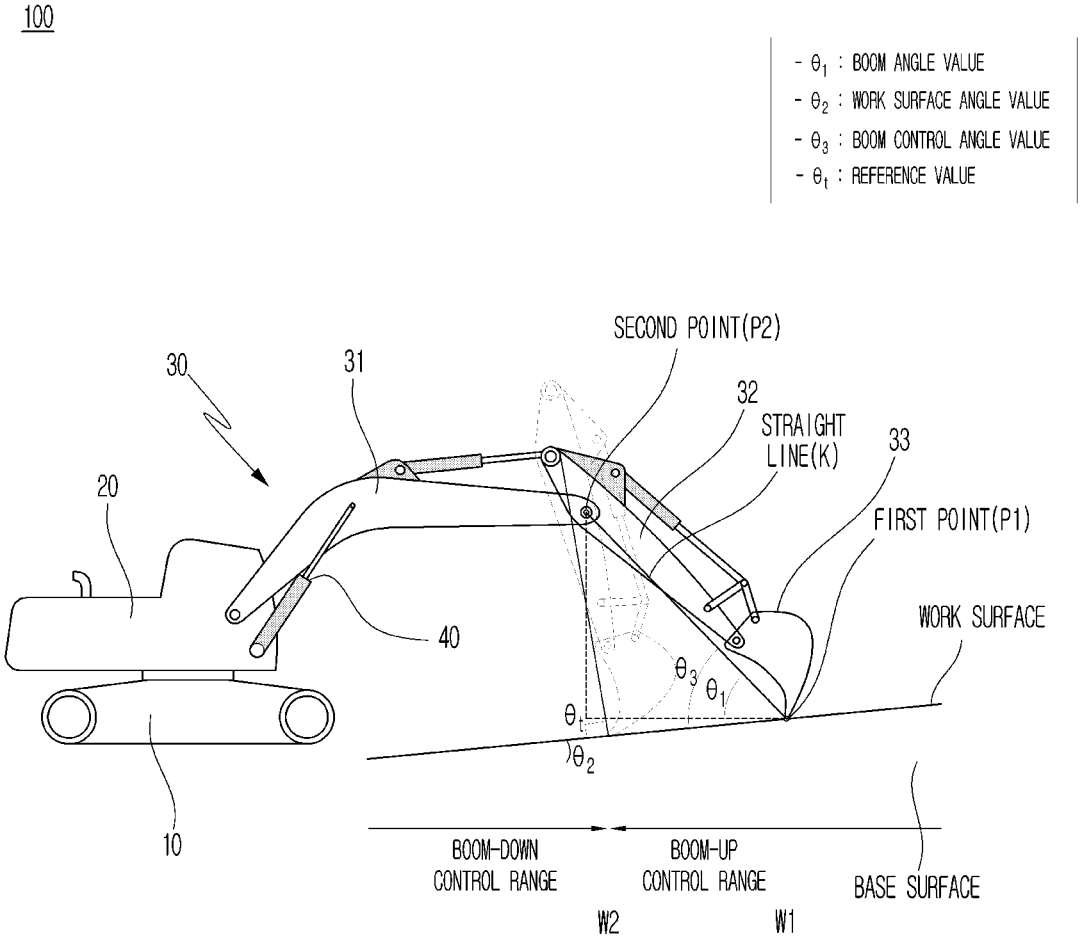

[Fig. 5]
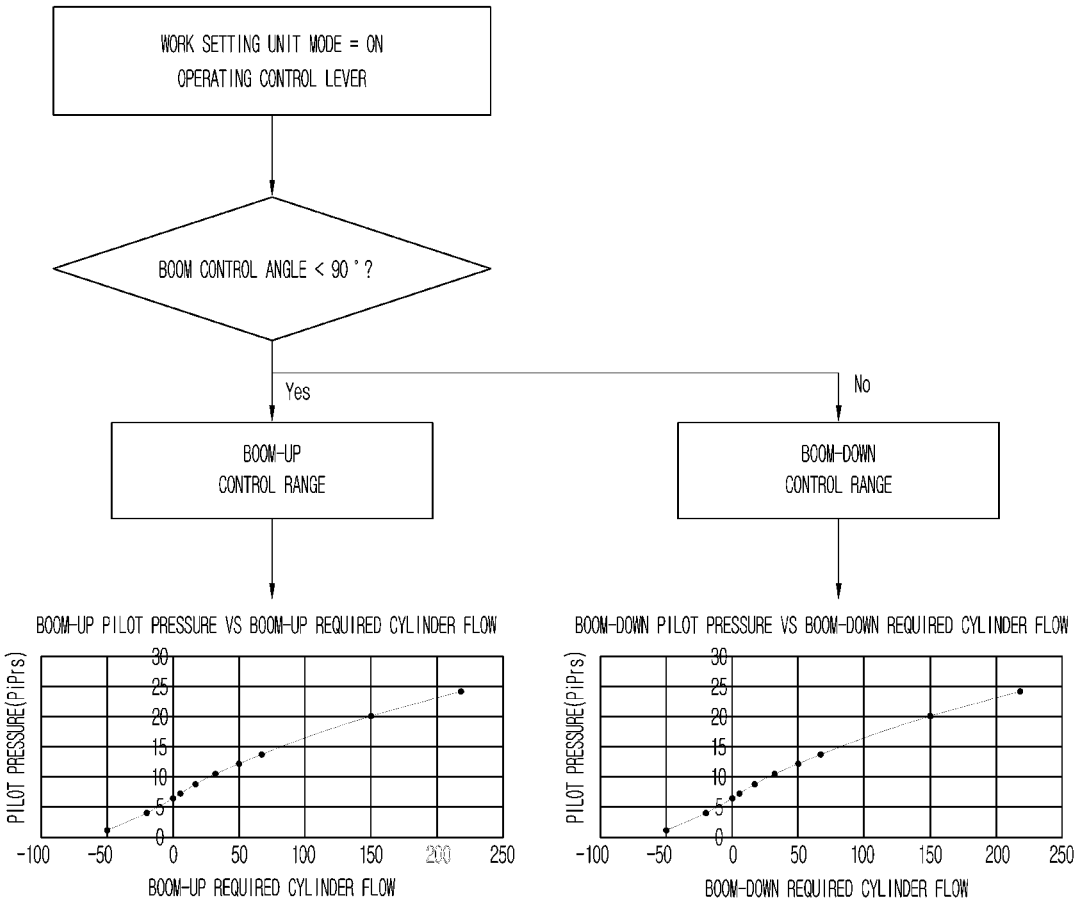

CONSTRUCTION EQUIPMENT

CROSS REFERENCE TO RELATED APPLICATIONS

This application is a 35 U.S.C. § 371 national stage application of PCT International Application No. PCT/KR2019/004108 filed on Apr. 5, 2019, the disclosure and content of which is incorporated by reference herein in its entirety.

TECHNICAL FIELD

The present invention relates to a construction equipment. More specifically, the present invention relates to a construction equipment having a boom shock mitigation function capable of minimizing vibration caused by shock, extending service life of the equipment, and reducing driver's work fatigue by controlling the spool on the basis of a boom control angle value.

BACKGROUND ART

In general, an excavator is a construction equipment performing various tasks such as digging for digging up the ground at construction sites, etc., loading for carrying soil, excavating for making a foundation, crushing for dismantling buildings, grading for cleaning the ground, and leveling for leveling the ground.

With reference to FIG. 1, a construction equipment 1 such as an excavator comprises an undercarriage 2, an upper swing body 3 rotatably supported on the undercarriage 2, and a work device 4 installed to operate vertically on the upper swing body 3.

In addition, the work device 4 is formed of multi-joints, and comprises a boom 4*a* which has a rear end thereof rotatably supported on the upper swing body 3, an arm 4*b* which has a rear end thereof rotatably supported on a tip of the boom 4*a*, and a bucket 4*c* rotatably installed on the tip side of the arm 4*b*. Also, hydraulic oil is provided as the user operates the lever, and a boom cylinder 5 (working actuator), an arm cylinder 6 (working actuator), and a bucket cylinder 7 (working actuator) operate the boom 4*a*, arm 4*b*, and bucket 4*c*, respectively.

Such construction equipment 1 operates a work device 4 such as a boom 4*a*, an arm 4*b*, a bucket 4*c*, etc. by its respective manual control lever. However, since the work device 4 carries out a rotational movement by being connected to each joint part, it requires considerable effort for the driver to operate each work device 4 separately and work in a predetermined area.

Therefore, in order to facilitate such work, Korean Patent No. 10-0974275 discloses a shock absorption device and method thereof for excavator. The shock absorption device disclosed in the Korean Patent ('275) uses a separate driving device which has a proximity sensor capable of detecting the rotation angle of the boom cylinder installed at a predetermined location, and controlling the control valve to control the hydraulic oil supplied to the boom cylinder according to the detection signal from the proximity sensor, in order to prevent the occurrence of shock in case the boom of the excavator is raised to maximum height by operating a control lever.

In addition, in the case of a conventional tracking work performed along a work surface, the control unit determines the distance from the bucket end to the work surface as a distance error, and controls the boom to cancel the distance error (FIG. 2). In other words, during arm-in operation, a boom-up operation is performed to reduce the distance error (−) when the bucket end is on a lower part of the work surface, or a boom-down operation is performed to reduce the distance error (+) when the bucket end is on an upper part of the work surface.

As such, boom-up operation or boom-down operation needs to be performed quickly and repeatedly according to the distance error. However, a driver with insufficient driving experience cannot operate the control lever delicately, thereby causing a shock due to the inertia of the work device during sudden operation. This shock not only reduces work efficiency by increasing the driver's work fatigue, but also shortens the service life by reducing the durability of the equipment.

SUMMARY OF INVENTION

Technical Task

The present invention aims at solving the above problems of the prior art. It is an object of the present invention to provide a construction equipment having a boom shock mitigation function capable of minimizing vibration caused by shock, extending service life of the equipment, and reducing driver's work fatigue by controlling the spool on the basis of the boom control angle value.

Means for Solving the Task

In order to achieve the above object, according to an aspect of the present invention, the present invention provides a construction equipment comprising: an undercarriage; an upper swing body rotatably supported on the undercarriage; a work device supported by the upper swing body and comprising a boom, an arm and a bucket, which operate by means of respective hydraulic cylinders; a control valve for controlling the boom cylinder; an electronic proportional pressure reducing valve for controlling a spool of the control valve; a control lever for outputting a control signal corresponding to the amount of control of a driver; a work setting unit for providing a work mode by the driver and a target work surface setting function; a location information providing unit for, according to a work setting of the work setting unit, collecting and/or calculating location information of the work device and location information of a work surface that has been set; and an electronic control unit for calculating and outputting boom pilot pressure for the electronic proportional pressure reducing valve, wherein the electronic control unit controls the operation of the boom by using the control signal of the control lever and the location information collected and/or calculated by the location information providing unit.

According to an embodiment of the present invention, the electronic control unit may set the location of the bucket end as a first point, the joint location of the boom and the arm as a second point, and an angle between a virtual straight line connecting the first point and the second point and the work surface as a boom control angle value.

According to an embodiment of the present invention, the electronic control unit may calculate the boom control angle value, and compare the calculated boom control angle value with the set reference value.

According to an embodiment of the present invention, the electronic control unit may determine the boom control angle value to be in boom-up control range and allow only boom-up movement in case the boom control angle value is smaller than the set reference value, and determine the boom control angle value to be in boom-down control range and allow only boom-down movement in case the boom control angle value is larger than the set reference value.

According to an embodiment of the present invention, the reference value may be 90°.

According to an embodiment of the present invention, the electronic control unit may calculate the boom control angle value to be a sum of the boom angle value, which is a tangent angle between the first point and the second point, and the slope angle of the work surface.

According to an embodiment of the present invention, the location information providing unit may comprise at least one of a location measuring unit for measuring the location information of the construction equipment, a posture measuring unit for measuring the posture information of the construction equipment and the location of the respective work device, and a coordinate calculating unit for calculating the coordinate on the basis of the location information measured from the location measuring unit and the posture measuring unit.

According to an embodiment of the present invention, the electronic proportional pressure reducing value may generate hydraulic pressure in correspondence to the electric signal of the electronic control unit, and operate the spool in the control valve by delivering the hydraulic pressure generated to the control valve.

According to an embodiment of the present invention, the control lever may generate an electric signal in proportion to the amount of control of a driver and provide the same to the electronic control unit as an electric joystick.

According to an embodiment of the present invention, the work setting unit may provide a plurality of work mode setting functions that can be set according to the driver's need, and display, on a display screen, at least one of the geographic information, location information and posture information of the construction equipment provided from the location information providing unit according to the work mode setting.

Effect of Invention

According to an aspect of the present invention, the shock caused by a switching operation between boom-up and boom-down may be prevented by controlling the spool of the control valve on the basis of the boom control angle value.

Also, the work efficiency may be improved by increasing the durability of the construction equipment and reducing the driver's work fatigue.

In addition, the driver may easily operate the work device regardless of driving experience.

The effects of the present invention are not limited to the above-mentioned effects, and it should be understood that the effects of the present disclosure include all effects that could be inferred from the configuration of the invention described in the detailed description of the invention or the appended claims.

BRIEF DESCRIPTION OF DRAWINGS

FIG. 1 is a perspective view illustrating a basic configuration of the construction equipment according to prior art;

FIG. 2 is a schematic diagram illustrating the movement of the boom during arm-in operation of the construction equipment according to prior art;

FIG. 3 is a schematic diagram illustrating a boom shock mitigation function of the construction equipment according to an embodiment of the present invention;

FIG. 4 is a schematic diagram illustrating the movement of the boom during arm-in operation of the construction equipment according to an embodiment of the present invention; and FIG. 5 is a flow chart illustrating a method for controlling the boom shock mitigation function of the construction equipment according to an embodiment of the present invention.

DETAILED MEANS FOR CARRYING OUT THE INVENTION

Hereinafter, embodiments of the present invention with be explained in detail with reference to FIGS. 1 to 5.

The construction equipment 100 according to an embodiment of the present invention comprises an undercarriage 10, an upper swing body 20 rotatably supported on the undercarriage 10, and a work device 30 supported by the upper swing body 20. The work device 30 comprises a boom 31, an arm 32, and a bucket 33 which operate by means of respective hydraulic cylinders.

Also, the construction equipment 100 according to an embodiment of the present invention has a boom shock mitigation function capable of minimizing the shock caused by the switching between boom-down and boom-up during the tracking work performed along the work surface.

FIG. 3 is a schematic diagram illustrating a boom shock mitigation function of the construction equipment according to an embodiment of the present invention, FIG. 4 is a schematic diagram illustrating the movement of the boom during arm-in operation of the construction equipment according to an embodiment of the present invention, and FIG. 5 is a flow chart illustrating a method for controlling the boom shock mitigation function of the construction equipment according to an embodiment of the present invention.

With reference to FIGS. 3 to 5, the construction equipment 100 having a boom shock mitigation function according to an embodiment of the present invention comprises an undercarriage 10, an upper swing body 20 rotatably supported on the undercarriage 10, a work device 30 supported by the upper swing body 20 and comprising a boom 31, an arm 32, and a bucket 33, which operate by means of respective hydraulic cylinders, a control valve 200 for controlling the boom cylinder 40, an electronic proportional pressure reducing valve 300 for controlling a spool of the control valve 200, a control lever 400 for outputting a control signal corresponding to the amount of control of a driver, a work setting unit 500 for providing a work mode and a target work surface setting function, a location information providing unit 600 for, according to a work setting of the work setting unit 500, collecting and/or calculating location information of the work device and location information of a work surface that has been set, and an electronic control unit 700 for calculating and outputting boom pilot pressure for the electronic proportional pressure reducing valve 300.

At this time, the electronic control unit 700 according to an embodiment of the present invention is configured to determine whether it is in the boom-up range or the boom-down range using the control signal of the control lever 400 and the location information collected and/or calculated by the location information providing unit 600, and when in the boom-up range, allow only boom-up operation, and when in the boom-down range, allow only boom-down operation.

The control valve 200 is a member for opening and closing the flow path by a spool moving in the axial direction under pressure. In other words, the control valve 200 serves to switch the supply direction of the hydraulic oil supplied by the hydraulic pump which is the hydraulic pressure source to the boom cylinder 40 side. The control valve 200 is connected to the hydraulic pump through a hydraulic pipe, and induces the supply of hydraulic oil from the hydraulic pump to the boom cylinder 40.

The electronic proportional pressure reducing valve 300 is an electronically operated valve, and may comprise a solenoid unit for generating an electromagnetic force and a valve unit for use as a fluid flow path.

The electronic proportional pressure reducing valve 300 generates hydraulic pressure in correspondence to an electric signal applied by the electronic control unit 700, and the generated hydraulic pressure is delivered from the electronic proportional pressure reducing valve 300 to the control valve 200. The hydraulic pressure from the electronic proportional pressure reducing valve 300 causes the spool in the control valve 200 to move axially.

More specifically, the electronic proportional pressure reducing valve 300 variably adjusts the boom-up signal pressure supplied to the spool of the control valve 200 according to the electric signal input from the electronic control unit 700 when it is determined by the electronic control unit 700 to be in the boom-up control range. In addition, the electronic proportional pressure reducing valve 300 variably adjusts the boom-down pressure supplied to the spool of the control valve 200 according to the electric signal input from the electronic control unit 700 when it is determined by the electronic control unit 700 to be in the boom-down control range.

The control lever 400 may be a hydraulic joystick or an electric joystick, and preferably may be an electric joystick which generates an electric signal in proportion to the amount of control of a driver and provides the same to the electronic control unit 700.

The location information providing unit 600 may comprise at least one of a location measuring unit 610 for measuring the location information of a construction equipment 100 by receiving a signal transmitted by a global positioning system (GPS) satellite, a posture measuring unit 620 for measuring the posture information of the construction equipment 100 and the location of at least one of the boom 31, the arm 32 and the bucket 33, and a coordinate calculating unit 630 for calculating the coordinates of the construction equipment 100 on the basis of the location information measured from the location measuring unit and the posture measuring unit.

The location measuring unit 610 may comprise a receiver capable of receiving a signal transmitted by a GPS satellite, and measure location information of the construction equipment 100 from the received signal.

The posture measuring unit 620 measures the location and/or posture of at least one of the boom 31, arm 32 and bucket 33 and the slope of the body of the construction equipment 100 using a plurality of inertial measurement units (IMUs) and angle sensors, etc.

The coordinate calculating unit 630 calculates the coordinates (x, y, z) of at least one of the boom 31, arm 32, and bucket 33 using the location information measured from the location measuring unit 610 and the posture measuring unit 620.

In addition, the location information providing unit 600 may further comprise a mapping unit for mapping the geographic information around the work location and the construction information on the work location to the calculated coordinates. The mapping unit maps by adjusting the location and/or posture of the respective work device 30 measured by the posture measuring unit and the slope of the body of the construction equipment 100 according to each axis calculated by the coordinate calculating unit.

The work setting unit 500 may comprise a work mode setting function which may be set in various ways according to the driver's needs, such as work area limit mode, swing position control mode, etc.

The work setting unit 500 displays at least one of the geographic information, location information, and posture information of the construction equipment 100 provided from the location information providing unit 600 on a display 510 screen according to the work mode setting. Accordingly, the driver may set the work mode and work easily using information displayed on the screen of the display 510 according to the set mode.

When a control signal of the control lever 400 is input, the electronic control unit 700 receives the location information from the location information providing unit 600 and determines whether it is in a boom-up or boom-down control range. Then, the electronic control unit 700 outputs a current signal for controlling the control valve 200 to the electronic proportional pressure reducing valve 300.

In other words, when the boom shock mitigation function according to the present invention is active, various location information is input to the electronic control unit 700 through the location information providing unit 600, and the electronic control unit 700 controls the movement of the boom 31 on the basis of the collected information.

With reference to FIG. 3, the construction equipment having a boom shock mitigation function according to the present invention operates as shown below.

First, the driver sets to active control mode on the work setting unit 500, and operates the arm-in control lever 400 to track the work surface. Then, the location information providing unit 600 collects and/or calculates the location information of the work device 30 and the predetermined work surface, and provides the same to the electronic control unit 700.

The electronic control unit 700 calculates the current boom angle value and a set work surface angle value according to the location of the boom 31, arm 32 and bucket 33 using the provided location information, and calculates the boom control angle value by reflecting the boom angle value and the set work surface angle value.

Here, the boom angle value means an angle between a virtual straight line connecting the joint of the bucket 33 end and the arm 32, and the base surface. The set work surface angle value means an angle between the base surface and the work surface. The boom control angle value means an angle between a virtual straight line connecting the joint of the bucket 33 end and the arm 32, and the work surface.

Next, the electronic control unit 700 compares the calculated boom control angle value with a predetermined reference value.

When the boom control angle value is smaller than the reference value, the electronic control unit 700 determines it to be in boom-up control range and controls to carry out only boom-up operation. Similarly, when the boom control angle value is greater than the reference value, the electronic control unit 700 determines it to be in boom-down control range and controls to carry out only boom-down operation.

In addition, in the boom-up control range, the electronic control unit 700 inputs boom-up pilot pressure corresponding to the boom-up required cylinder flow required during boom up to the electronic proportional pressure reducing valve 300 at the boom up side by operating the control lever 400. Similarly, in the boom-down control range, the electronic control unit 700 inputs the boom-down pilot pressure corresponding to the boom-down required cylinder flow required during boom down to the electronic proportional pressure reducing valve 300 at the boom down side by operating the control lever 400.

The electronic proportional pressure reducing valve 300 generates hydraulic pressure in correspondence to the flow control pilot pressure input from the electronic control unit 700, and the generated hydraulic pressure is supplied to the spool of the control valve 200. In other words, the electronic proportional pressure reducing valve 300 supplies hydraulic pressure to the spool of the control valve 200 so as to carry out boom-up operation upon receiving boom-up pilot pressure from the electronic control unit 700. Similarly, the electronic proportional pressure reducing valve 300 supplies hydraulic pressure to the spool of the control valve 200 so as to carry out boom-down operation upon receiving boom-down pilot pressure.

When hydraulic pressure is supplied to the spool of the control valve 200 for boom-up operation, a flow is created to the piston-side chamber of the boom cylinder 40, and accordingly the boom 31 is raised due to the expansion of the boom cylinder 40. Similarly, when hydraulic pressure is supplied to the spool of the control valve 200 for boom-down operation, a flow is created to the rod-side chamber of the boom cylinder 40, and accordingly the boom 31 is dropped due to the contraction of the boom cylinder 40.

In other words, while carrying out tracking work along the work surface, the electronic control unit 700 does not give a boom-up signal in a situation where a boom-down signal is to be given and does not give a boom-down signal in a situation where a boom-up signal is to be given, so as to prevent the occurrence of shock caused by switching between boom-down and boom-up.

With reference to FIG. 4, a method for controlling the boom 31 of the electronic control unit 700 during arm 32 in operation according to an embodiment of the present invention will be described in detail as shown below.

The electronic control unit 700 calculates the current boom angle value $\theta_1$ according to the location of each work device and the set work surface angle value $\theta_2$ by using the location information provided from the location information providing unit 600, and calculates the boom control angle value $\theta_3$ by reflecting the boom angle value $\theta_1$ and the set work surface angle value $\theta_2$.

According to an embodiment, the electronic control unit 700 may set the location of the bucket 33 end as a first point P1 and the joint location of the arm 32 as a second point P2.

Here, the boom angle value $\theta_1$ means an angle formed between a base surface and a virtual straight line K connecting the first point P1 and the second point P2. In other words, the boom angle value means the tangent angle between the first point P1 and the second point P2.

In addition, the set work surface angle value $\theta_2$ means an angle between the base surface and the set work surface.

At this time, the boom control angle value $\theta_3$ means an angle between the set work surface and a virtual straight line K connecting the first point P1 and the second point P2.

In addition, the boom control angle value $\theta_3$ is calculated by reflecting the boom angle value θ1 and the set work surface angle value $\theta_2$. In other words, the boom control angle $\theta_3$ may be a sum of the boom angle value θ1 and the set work surface angle value $\theta_2$.

Next, with reference to FIGS. 4 and 5, in a situation where the construction equipment 100 carries out tracking work along the set work surface, the driver carries out an arm-in operation in order to move the bucket 33 end currently located in a first location W1 to a second location W2.

At this time, the boom 31 needs to be controlled to carry out a boom-up operation so that the bucket 33 end does not invade the work surface.

Here, the second location W2 is a reference location in which the boom control angle $\theta_3$ is 90°. The boom control angle value $\theta_3$ at this time is the reference value $\theta_t$ which determines whether it is in the boom up control range and the boom down control range.

When the bucket 33 end is in a first location W1, the boom control angle value $\theta_3$ is the sum of the boom angle value $\theta_1$ and the set work surface angle value $\theta_2$, which is smaller than the reference value $\theta_t$, 90°. In other words, it means that the bucket 33 end is in the boom up control range.

Accordingly, the electronic control unit 700 allows only boom-up operation. In other words, a boom-up pilot pressure corresponding to the boom-up required cylinder flow is input to the boom-up side electronic proportional pressure reducing valve 300 according to the operation of the control lever 400.

In addition, the electronic proportional pressure reducing valve 300 supplies hydraulic pressure to the spool of the control valve 200 so as to carry out boom-up operation upon receiving boom-up pilot pressure from the electronic control unit 700.

Accordingly, the control valve 200 creates a flow to the piston-side chamber of the boom cylinder 40, and accordingly the boom 31 is raised due to the expansion of the boom cylinder 40.

In other words, according to the present invention, the shock caused by the switching between boom-down and boom-up may be prevented by not giving a boom-down signal in a situation where a boom-up signal is to be given while carrying out tracking work along a work surface.

In a situation where the construction equipment 100 continues to carry out tracking work along the set work surface, the driver performs an arm-in operation to inwardly move the bucket 33 end located in the second location W2.

At this time, the boom 31 needs to be controlled to carry out a boom-down operation so that the bucket 33 end does not deviate from the work surface.

When the arm-in operation is performed so that the bucket 33 end inwardly moves beyond the second location W2, the boom control angle value $\theta_3$ is the sum of the boom angle value $\theta_1$ and the set work surface angle value $\theta_2$, and has a value greater than the reference value $\theta_t$, 90°. In other words, this means that the bucket 33 end is in the boom down control range.

Accordingly, the electronic control unit 700 allows only boom-down operation. In other words, only a boom-down pilot pressure corresponding to the boom down required cylinder flow is input to the boom down side electronic proportional pressure reducing valve 300 according to the operation of the control lever 400.

In addition, the electronic proportional pressure reducing valve 300 supplies hydraulic pressure to the spool of the control valve 200 so as to perform boom-down operation upon receiving boom-down pilot pressure from the electronic control unit 700.

Accordingly, the control valve 200 creates a flow to the rod-side chamber of the boom cylinder 40, and accordingly the boom 31 is dropped due to the contraction of the boom cylinder 40.

In other words, according to the present invention, the shock caused by the switching between boom-down and boom-up may be prevented by not giving a boom-up signal in a situation where a boom-down signal is to be given while carrying out tracking work along a work surface.

As such, shock caused by the switching operation of the boom 31 may be prevented by allowing the spool of the control valve 200 to be controlled on the basis of the boom control angle value. Accordingly, the work efficiency may be improved by increasing the durability of the construction equipment 100 and reducing the driver's work fatigue.

In addition, both a driver with sufficient driving experience or a driver with insufficient driving experience may easily operate the work device 30.

The foregoing description of the present invention has been presented for illustrative purposes, and it is apparent to a person having ordinary skill in the art that the present invention can be easily modified into other detailed forms without changing the technical idea or essential features of the present invention.

The scope of the present invention is presented by the accompanying claims, and it should be understood that all changes or modifications derived from the definitions and scopes of the claims and their equivalents fall within the scope of the present invention.

DESCRIPTION OF REFERENCE NUMERALS

100: construction equipment
10: undercarriage
20: upper swing body
30: work device
31: boom
32: arm
33: bucket
40: boom cylinder (working actuator)
50: arm cylinder (working actuator)
60: bucket cylinder (working actuator)
200: control valve
300: electronic proportional pressure reducing valve
400: control lever
500: work setting unit
510: display
600: location information providing unit
610: location measuring unit
620: posture measuring unit
630: coordinate calculating unit
700: electronic control unit
P1: first point
P2: second point
W1: first location
W2: second location
$\theta_1$: boom angle value
$\theta_2$: work surface angle value
$\theta_3$: boom control angle value
$\theta_r$: reference value

What is claimed is:

1. A construction equipment comprising:

an undercarriage;

an upper swing body rotatably supported on the undercarriage;

a work device supported by the upper swing body and comprising a boom, an arm, and a bucket, which operate by means of respective hydraulic cylinders;

a control valve for controlling the boom cylinder;

an electronic proportional pressure reducing valve for controlling a spool of the control valve;

a control lever for outputting a control signal corresponding to the amount of control of a driver;

a work setting unit for providing a work mode and a target work surface setting function;

a location information providing unit for, according to a work setting of the work setting unit, collecting and/or calculating location information of the work device and location information of a work surface that has been set; and an electronic control unit for calculating and outputting boom pilot pressure for the electronic proportional pressure reducing valve, wherein the electronic control unit controls the operation of the boom by using the control signal of the control lever and the location information collected and/or calculated by the location information providing unit, wherein the electronic control unit sets the location of the bucket end as a first point, the joint location of the boom and the arm as a second point, and an angle between a virtual straight line connecting the first point and the second point and the work surface as a boom control angle value, wherein the electronic control unit calculates the boom control angle value, and compares the calculated boom control angle value with the set reference value, wherein the electronic control unit determines the boom control angle value to be in boom-up control range and allows only boom-up movement in case the boom control angle value is smaller than the set reference value, and determines the boom control angle value to be in boom-down control range and allows only boom-down movement in case the boom control angle value is larger than the set reference value.

2. The construction equipment of claim 1, wherein the reference value is 90°.

3. The construction equipment of claim 1, wherein the electronic control unit calculates the boom control angle value to be a sum of the boom angle value, which is a tangent angle between the first point and the second point, and the slope angle of the work surface.

4. The construction equipment of claim 1, wherein the location information providing unit comprises at least one of a location measuring unit for measuring the location information of the construction equipment, a posture measuring unit for measuring the posture information of the construction equipment and the location of the respective work device, and a coordinate calculating unit for calculating the coordinate on the basis of the location information measured from the location measuring unit and the posture measuring unit.

5. The construction equipment of claim 1, wherein the electronic proportional pressure reducing value generates hydraulic pressure in correspondence to the electric signal of the electronic control unit, and operates the spool in the control valve by delivering the hydraulic pressure generated to the control valve.

6. The construction equipment of claim 1, wherein the control lever generates an electric signal in proportion to the amount of control of a driver and provides the same to the electronic control unit as an electric joystick.

7. The construction equipment of claim 1, wherein the work setting unit provides a plurality of work mode setting functions that can be set according to the driver's need, and displays, on a display screen, at least one of the geographic information, location information and posture information of the construction equipment provided from the location information providing unit according to the work mode setting.

* * * * *